US006665578B2

(12) United States Patent
Ochi et al.

(10) Patent No.: US 6,665,578 B2
(45) Date of Patent: Dec. 16, 2003

(54) LINKING METHOD AND LINKING APPARATUS

(75) Inventors: Naomasa Ochi, Nara-ken (JP); Ryosuke Mori, Nara-ken (JP); Takahiro Wada, Takamatsu (JP)

(73) Assignee: Dan Co., Ltd., Osaka (JP)

( * ) Notice: Subject to any disclaimer, the term of this patent is extended or adjusted under 35 U.S.C. 154(b) by 0 days.

(21) Appl. No.: 10/307,312

(22) Filed: Dec. 2, 2002

(65) Prior Publication Data

US 2003/0106345 A1 Jun. 12, 2003

(30) Foreign Application Priority Data

Dec. 7, 2001 (JP) ..... 2001-373504

(51) Int. Cl.[7] ..... D04B 35/10; D05B 7/00

(52) U.S. Cl. ..... 700/141; 112/27; 112/475.02; 66/148

(58) Field of Search ..... 700/141, 143, 700/144; 112/27, 25, 475.02; 66/148, 8, 58, 104, 166

(56) References Cited

U.S. PATENT DOCUMENTS 4,846,085 A * 7/1989 Ishibashi et al. ..... 112/27
6,397,121 B1 * 5/2002 Kawamura et al. ..... 700/141

* cited by examiner

*Primary Examiner*—Peter Nerbun
(74) *Attorney, Agent, or Firm*—Keating & Bennett, LLP

(57) ABSTRACT

A linking method including the steps of opposing knitted fabrics to be linked to each other, stretching the opposed knitted fabrics in a course direction, stretching the opposed knitted fabrics in a wale direction, picking up an image of linking loops of each of the stretched knitted fabrics, detecting the positions of the linking loops based on a multiple gray-scale image, inserting a point needle through each of the linking loops, sewing a linking loop in the vicinity of an edge of each of the knitted fabrics, and linking together the linking loops other than the sewn linking loop by using the point needle; and an apparatus for linking knitted fabrics.

20 Claims, 9 Drawing Sheets

LINKING METHOD AND LINKING APPARATUS

BACKGROUND OF THE INVENTION

1. Field of the Invention

The present invention relates to a linking method and a linking apparatus, and in particular, to a linking method and a linking apparatus enabling quick and accurate linking of knitted fabrics.

2. Description of the Prior Art

In a knitted fabric, a loose course is conventionally formed. The loose course consists of knitted loops which are larger than the other knitted loops (hereinafter, such large knitted loops are referred to simply as linking loops) such that the knitted fabric is linked to another knitted fabric to produce the defined size and shape of a product when the knitted loops are joined to each other by linking. When a knitted fabric is disposed on a linking apparatus, an operator stretches the knitted fabric with both hands so as to look through the knitted fabric to identify the linking loops which define a loose course. In this manner, the operator inserts a point needle through each of the linking loops defining the loose course.

This operation is performed in a similar manner for a tubular knitted fabric having a tubular shape. First, an operator puts his (her) hands into an opening of a tubular knitted fabric to laterally stretch the tubular knitted fabric so as to look through the knitted fabric on a far side when seen from the operator. In this manner, the operator identifies linking loops so as to insert a point needle of a linking apparatus through each of the linking loops.

Thereafter, the operator performs a similar operation for the knitted fabric on the operator side, thereby attaching the tubular knitted fabric to the linking apparatus.

However, it is extremely difficult to insert point needles through the linking loops because the linking loops are only slightly larger than normally knitted loops. For the tubular knitted fabric, in particular, after piercing point needles through a knitted fabric on the far side, it is difficult to stretch the knitted fabric on the operator side. Therefore, the difficulty of piercing with the point needles is increased.

As a result, the linking operation disadvantageously takes a long time to complete. Moreover, an inconvenience occurs in that point needles are withdrawn when linking of the loops is carried. Consequently, the yield of products is reduced.

In view of the problems described above, methods described in Japanese Patent Laid-Open Publication Nos. Hei. 11-207061 and 11-207062 have been developed. In the methods disclosed in the above-cited patent publications, it is necessary to insert a point needle through linking loops while one-by-one adjusting the positions of the point needles with respect to the linking loops in a linking operation because the linking loops are rarely placed at constant intervals. Moreover, in these methods, it is necessary to manually insert point needles through the linking loops provided on the edge of a knitted fabric because it is difficult to detect the linking loops provided in the vicinity of the edge of the knitted fabric. As a result, the amount of time required to complete the linking is increased, making it impossible to quickly perform the linking.

SUMMARY OF THE INVENTION

To overcome the problems described above, preferred embodiments of the present invention provide a linking method and a linking apparatus, which allow point needles to be quickly and accurately inserted through linking loops formed in a knitted fabric so as to enable tight and accurate linking of knitted fabrics.

A first preferred embodiment of the present invention provides a method for linking knitted fabrics, each having a loose course for linking, including the steps of opposing the knitted fabrics to be linked to each other, stretching the opposed knitted fabrics in a course direction, stretching the opposed knitted fabrics in a wale direction, picking up a multiple gray-scale image including an image of linking loops defining a loose course of each of the stretched knitted fabrics, performing an image processing on the multiple grayscale image so as to detect positions of the linking loops, inserting a point needle through each of the linking loops, sewing a linking loop in the vicinity of an edge of each of the knitted fabrics, and threading the linking loops other than the sewn linking loop by using the point needle inserted through the linking loop so as to link the knitted fabrics together.

In the first preferred embodiment, the linking loops in the vicinity of the edges of the knitted fabrics are quickly and accurate linked. The remaining linking loops are accurately threaded to perform the linking.

The step of sewing the linking loop in the vicinity of the edge of each of the knitted fabrics preferably involves threading one linking loop a plurality of times.

With this step, the linking loops in the vicinity of the edges of the knitted fabrics are more tightly linked.

The step of stretching the opposed knitted fabrics in the course direction includes piercing a plurality of needles through the knitted fabrics while the knitted fabrics are being stretched in the course direction so as to fix the knitted fabrics With this step, the knitted fabrics in a stretched state become stable, thereby enabling more accurate linking.

The step of stretching the opposed knitted fabrics in the course direction according to the first preferred embodiment preferably further includes the steps of pinching the opposed knitted fabrics in a stretched state in the course direction, and piercing a plurality of needles through the knitted fabrics which are pinched in a stretched state so as to fix the knitted fabrics.

With these addition steps, the knitted fabrics in a stretched state is even more stable, thereby enabling more accurate linking.

The step of performing the image processing on the multiple gray-scale image so as to detect the positions of the linking loops according to the first preferred embodiment preferably includes detecting the positions of the linking loops by pattern matching.

With this step, large knitted loops formed immediately above or immediately below the loose course are not mis-recognized as linking loops, thereby enabling more accurate linking.

The linking method according to the first preferred embodiment preferably further includes the step of placing a plate-like material between the opposed knitted fabrics, the plate-like material having a visual effect which allows clear visualization of a boundary between a knitted portion of the knitted fabric and a portion including no knitting yarn.

With this step, the positions of the linking loops is easily detected, thereby enabling more accurate linking.

The plate-like material preferably emits light, such that the positions of the linking loops are more easily detected, thereby enabling more accurate linking.

The knitted fabrics according to the first preferred embodiment preferably defined a tubular knitted fabric, and the step of opposing the knitted fabrics to be linked involves opposing the knitted fabrics to each other into a shape to be formed by linking the tubular knitted fabric, so as to quickly link the linking loops present in the vicinity of an edge of the tubular knitted fabric which is flattened or nearly flattened such that the knitted fabrics to be linked together are opposed to each other. Moreover, the remaining linking loops are accurately threaded to be linked together.

Each of the knitted fabrics according to the first preferred embodiment preferably includes a course formed to have a thin thickness, and the step of pinching the opposed knitted fabrics in the stretched state in the course direction involves pinching each of the knitted fabrics at the course formed to have the thin thickness, such that the knitted fabrics is easily and firmly pinched along the loose course so as to allow the loose course to be regularly arranged. As a result, accurate and quick linking is made possible.

Each of the knitted fabrics according to the first preferred embodiment preferably include a loose course formed in a vicinity of the course formed to have a thin thickness, and the step of pinching the opposed knitted fabrics in a stretched state in the course direction involves pulling a side of each of the knitted fabrics where the loose course is not formed in a state where the knitted fabrics at the course formed to have the thin thickness are pinched so as to arrange the loose course along an edge of a member pinching the knitted fabrics, such that the loose course is more regularly arranged, thereby enabling more accurate and quick linking.

A second preferred embodiment of the present invention provides a linking apparatus for linking knitted fabrics, each having a loose course for linking, including a course stretching device for stretching the knitted fabrics in a course direction in a state where the knitted fabrics are opposed to each other, a wale stretching device for stretching the opposed knitted fabrics in a wale direction, an image-pickup device for picking up a multiple gray-scale image including an image of linking loops constituting a loose course of each of the stretched knitted fabrics, a linking loop detection device for performing an image processing on the multiple gray-scale image so as to detect positions of the linking loops, a point needle insertion device for inserting a point needle through each of the linking loops, and a sewing machine mechanism for sewing a linking loop in a vicinity of an edge of each of the knitted fabrics and for threading the linking loops other than the sewn linking loop by using the point needle inserted through the linking loops to link the linking loops together.

With the linking apparatus according to the second preferred embodiment of the present invention, the linking loops present in the vicinity of an edge of the knitted fabric are quickly linked, whereas the remaining linking loops are accurately threaded to be linked together.

The sewing machine mechanism according to the second preferred embodiment threads the linking loop in the vicinity of the edge of each of the knitted fabrics for a plurality of times, such that the linking loops in the vicinity of the edges of the knitted fabrics are more tightly linked.

The course stretching device according to the second preferred embodiment is preferably defined by a plurality of needles piercing through the knitted fabrics while the knitted fabrics are being stretched in the course direction, such that the knitted fabrics in a stretched state become stable, thereby enabling more accurate linking.

The course stretching device according to the second preferred embodiment preferably further includes a pinching device for pinching the opposed knitted fabrics in a stretched state in the course direction, and a fixation device for piercing a plurality of needles through the knitted fabrics which are pinched in a stretched state so as to fix the knitted fabrics, such that the knitted fabrics in a stretched state become stable, thereby enabling more accurate linking.

The linking loop detection device according to the second preferred embodiment preferably detects the positions of the linking loops by pattern matching, such that large knitted loops formed immediately above or immediately below the loose course are not misrecognized as linking loops, thereby enabling more accurate linking.

The linking apparatus according to the second preferred embodiment of the present invention preferably further includes a plate-like material having a visual effect which allows clear visualization of a boundary between a knitted portion of the knitted fabric and a portion including no knitting yarn when the plate-like material is placed between the opposed knitted fabrics, such that the positions of the linking loops are easily detected, thereby enabling more accurate linking.

The plate-like material is preferably a light emitter. such that the positions of the linking loops are more easily detected, thereby enabling more accurate linking.

In this case, it is possible to quickly link the linking loops present in the vicinity of an edge of the tubular knitted fabric which is flattened or nearly flattened so that the knitted fabrics to be linked together are opposed to each other. Moreover, the remaining linking loops are accurately threaded to be linked together.

The knitted fabrics preferably define a tubular knitted fabric, and the course stretching device and the wale stretching device stretch the tubular knitted fabric while the knitted fabrics are being opposed to each other into a shape to be formed by linking the tubular knitted fabric.

In this case, the knitted fabrics can be easily and firmly pinched along the loose course so as to allow the loose course to be regularly arranged. As a result, accurate and quick linking is made possible.

Each of the knitted fabrics preferably includes a course having a thin thickness, and the pinching device for pinching the opposed knitted fabrics in the stretched state in the course direction pinches each of the knitted fabrics at the course having the thin thickness, such that the loose course is more regularly arranged, thereby enabling more accurate and quick linking.

Each of the knitted fabrics preferably includes a loose course formed in a vicinity of the course having the thin thickness, and the pinching device for pinching the opposed knitted fabrics in the stretched state in the course direction includes a pulling device for pulling a side of each of the knitted fabrics where the loose course is not formed in a state where the knitted fabrics at the course formed to have the thin thickness are pinched so as to arrange the loose course along an edge of the pinching device.

Other features, elements, advantages and characteristics of the present invention will become more apparent from the following detailed description of preferred embodiments thereof with reference to the attached drawings.

DETAILED DESCRIPTION OF THE PREFERRED EMBODIMENTS

Figure 1:
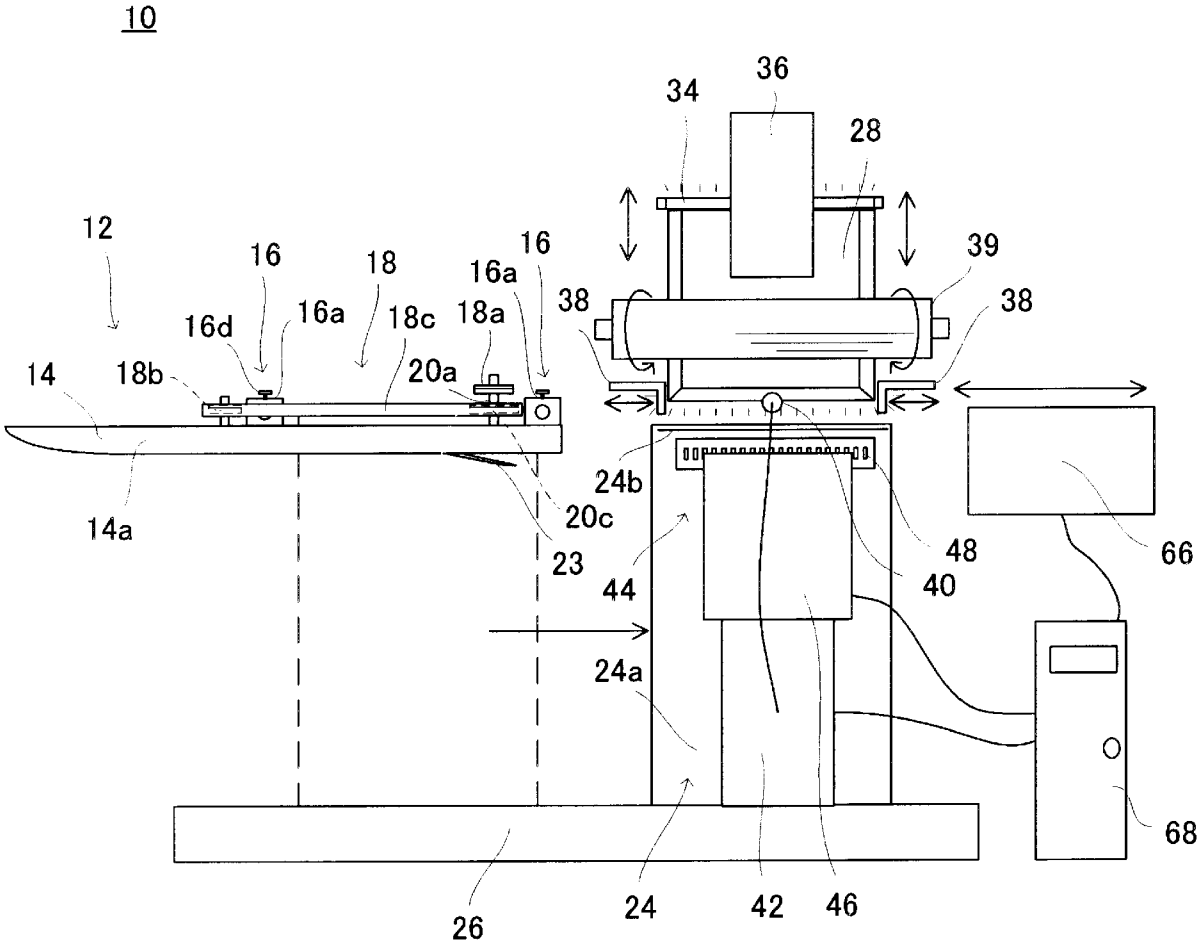
FIG. 1 is a diagram showing a preferred embodiment of a linking apparatus according to the present invention.
Figure 2:
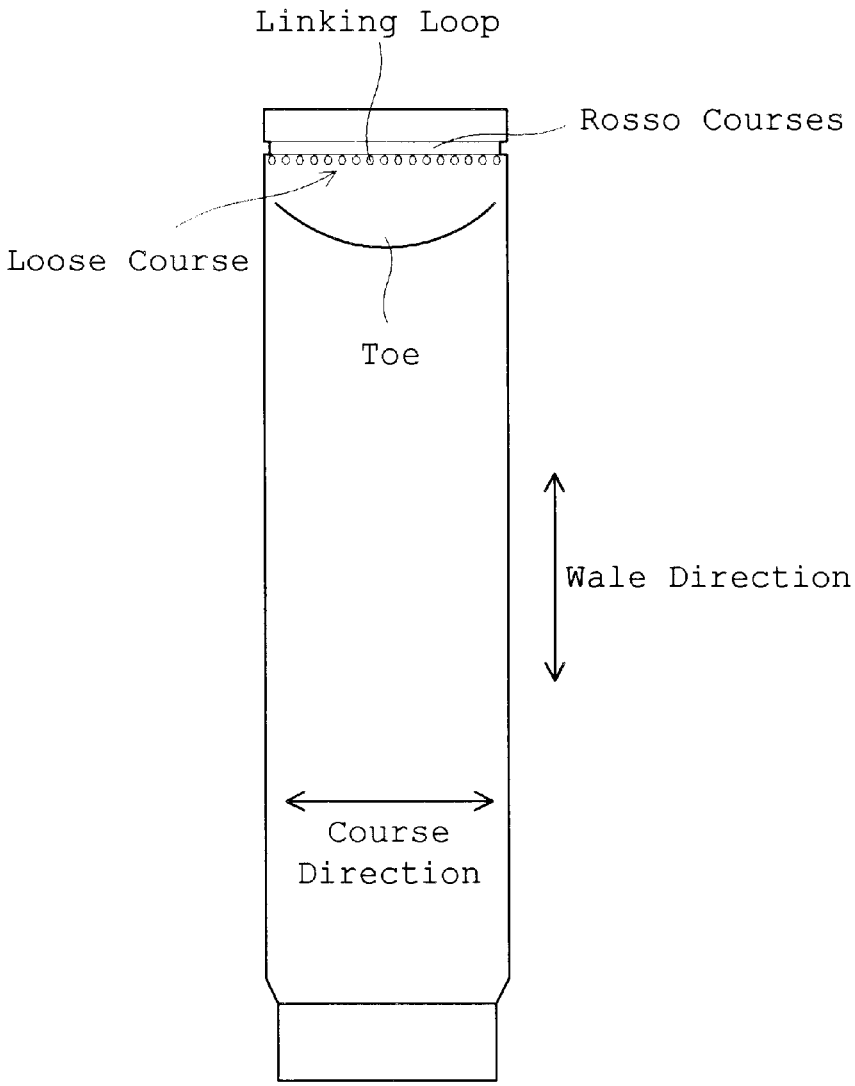
FIG. 2 is a diagram showing a tubular knitted fabric to be linked in the preferred embodiment.

FIG. 1 is a diagram showing a preferred embodiment of a linking apparatus according to the present invention. The linking apparatus 10 according to this preferred embodiment is optimized to link a tubular knitted fabric to be formed into a sock as shown in FIG. 2. The sock is formed by linking loops defining a loose course formed in the vicinity of a toe of the tubular knitted fabric. A tubular knitted fabric to be linked in this preferred embodiment includes Rosso courses. The Rosso courses correspond to two courses arranged above the loose course, and have a smaller thickness than that of the remaining knitted fabric by reducing the number of knitting yarns or by changing knitting yarns with finer ones for these two courses.

The linking apparatus 10 includes a pinching transfer section 12 as shown in FIG. 1. The pinching transfer section 12 transfers the tubular knitted fabric in a stretched state in a course direction and a wale direction while holding the tubular knitted fabric at the Rosso courses, the tubular knitted fabric being flattened such that linking loops to be linked are approximately opposed to each other. The pinching transfer section 12 includes a pinching tool 14.

Figure 3:
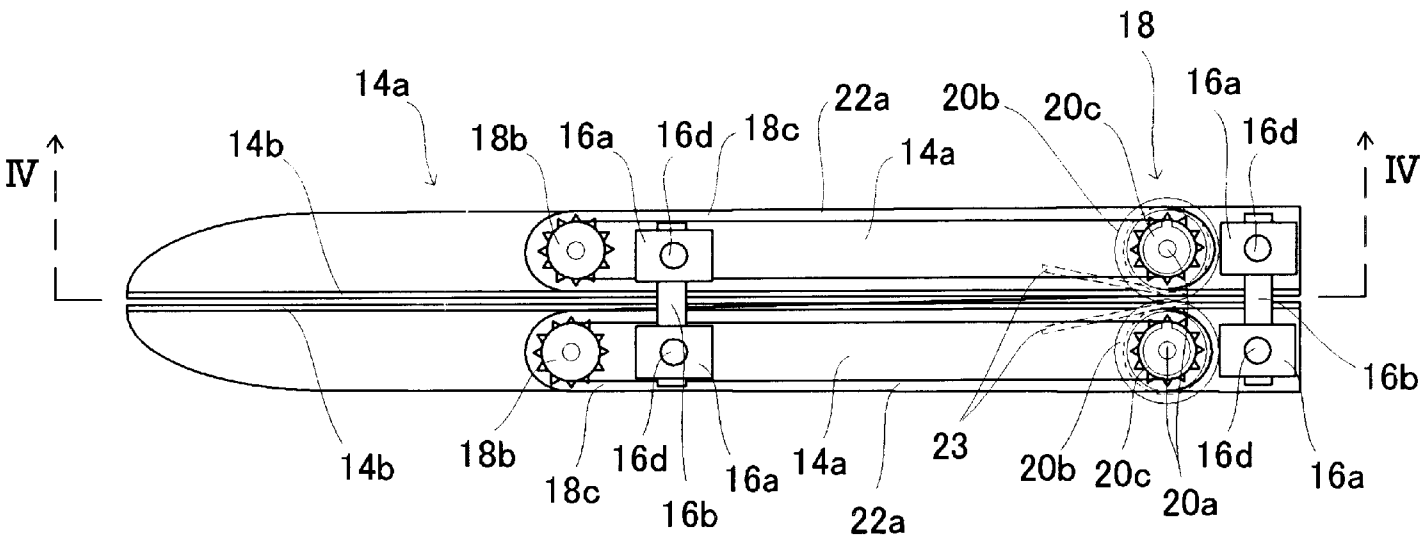
FIG. 3 is a plan view showing a pinching tool.
Figure 4:
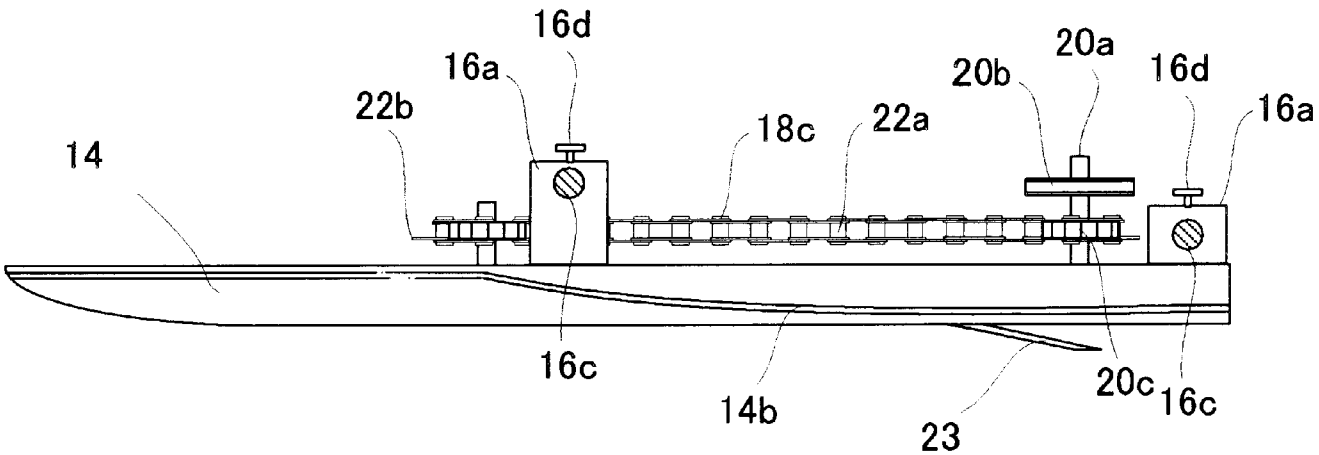
FIG. 4 is a cross-sectional view, taken along a line IV—IV in FIG. 3.

The pinching tool 14 holds the flattened tubular knitted fabric at its Rosso courses. The pinching tool 14 is defined by a pair of pinching members 14*a*. Each of the pinching members 14*a* has a gradually reducing thickness and width from its approximately middle portion toward its tip, as shown in FIGS. 3 and 4. Each of the opposing faces of the pinching members 14*a* has a linear plane shape as shown in FIG. 3.

A projecting line 14*b* is provided on each of the opposing faces of the pinching members 14*a* so as to extend from one end of the pinching member 14*a* to the other end. The projecting line 14*b* has a fixed height and a fixed width. In this preferred embodiment, the projecting line 14*b* has a height of 1 mm from the opposing faces of the pinching members 14*a*, and a width of 1.2 mm. The projecting line 14*b* has a varying height position from the vicinity of the approximately middle portion of the pinching member 14*a* toward its rear end to form a curved line as shown in FIG. 4.

The pinching members 14*a* are connected to each other by connection members 16. Each of the connection members 16 includes fixedly attached portions 16*a* and a connecting portion 16*b*. The fixedly attached portions 16*a* are fixedly attached to the rear end and the approximate middle portion of an upper face of each of the pinching members 14*a*, respectively. A through hole 16*c* is provided through the fixedly attached portion 16*a* in a direction in which the pinching members 14*a* are opposed to each other. The connecting portion 16*b* is made of a bar-shaped material. After being passed through the through hole 16*c*, the connecting portion 16*b* is fixed by a stopper 16*d* via a screw structure so as to connect the pinching members 14*a* to each other. The connection members 16 connects the pinching members 14*a* to each other such that a gap between the projecting lines 14*b* is smaller than a thickness of normally knitted portions of the flattened tubular knitted fabric (a portion other than the Rosso courses). The gap between the projecting lines 14*b* is constant from the tip to the rear end. The connection members 16 can vary the gap between the projecting lines 14*b* by varying the relative fixed position between the fixedly attached portion 16*a* and the connecting portion 16*b*.

On an upper face of each of the pinching members 14*a*, a transfer tool 18 is attached so as to extend from the approximate middle portion to the rear end of the pinching member 14*a*. The transfer tool 18 includes driving gear parts 18*a*, gears 18*b*, and a transfer chain 18*c*. Each of the driving gear parts 18*a* includes a rotation axis 20*a* attached rotatably onto an upper surface of the pinching member 14*a* in a vertical direction so as to be arranged inside the fixedly attached portion 16*a* on the rear end. A driving gear 20*b* and a chain gear 20*c* are fixedly attached to the rotation axis 20*a* of the driving gear part 18*a*. The driving gear 20*b* mates with a gear (not shown) for transferring the driving power supplied from a driving power source such as a motor so as to be rotated. The driving gears 20*b* mate with each other. The driving gears 20*b* are configured such that, when one of the driving gears 20*b* is rotated by the gear for transferring the driving power from the driving power source, the other driving gear 20*b* is driven by that rotation. Under the driving gear 20*b*, the chain gear 20*c* is fixedly attached. The chain gear 20*c* includes teeth to mate with the transfer chain 18*c* so as to move the transfer chain 18*c* in response to the rotation of the driving gear 20*b*.

The gear 18*b* includes a rotation axis attached rotatably onto an upper surface of the pinching member 14*a* in a vertical direction so as to be situated outside the fixedly attached portion 16*a* at the approximate middle portion of the pinching member 14*a*. The gear 18*b* is attached at the same height as the chain gear 20*c* of the driving gear part 18*a*.

Figure 5:
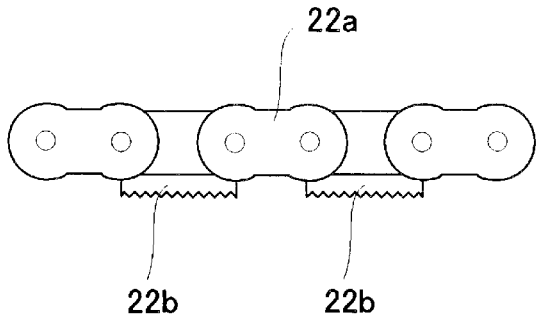
FIG. 5 is a plan view showing a portion of a chain.

The transfer chain 18*c* includes a circular chain 22*a* provided so as to extend between the gear 18*b* and the chain gear 20*c*. The chain 22*a* is provided so as to be parallel to an edge of the pinching member 14*a* when passing through the side where the pinching members 14*a* face each other. Moreover, the chain 22*a* is arranged so as to have a desired distance from the edge of the pinching member 14*a* when passing through the side where the pinching members 14*a* face each other. On an outer periphery of the chain 22*a*, gearing teeth 22*b* are provided in an outwardly protruding manner as shown in FIG. 5. The gearing teeth 22*b* cooperate with the opposing gearing teeth 22*b* so as to stop the tubular knitted fabric with the gearing teeth and transfer the tubular knitted fabric. As a result, the tubular knitted fabric transferred by the transfer chain 18*c* extends from the rear end of the pinching members 14*a* while being stretched in a course direction.

On the respective bottom faces of the pinching members 14*a* in the vicinity of their rear ends, knitted fabric guides 23 are attached. The knitted fabric guides 23 hold the tubular knitted fabric which hangs downwardly from the pinching member 14*a* while transferring the tubular knitted fabric. The knitted fabric guides 23 prevent the downwardly hanging tubular knitted fabric from swinging and moving in a lateral direction of the pinching members 14*a*. These knitted fabric guides 23 ensure accurate insertion of needles 24*b* described below.

Figure 6:
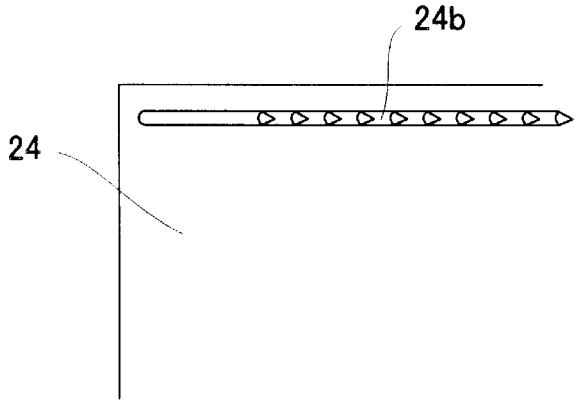
FIG. 6 is a partially enlarged view showing a needle.

In the rear of the end of the pinching transfer section 12 from which the tubular knitted fabric extends, a knitted fabric fixing tool 24 is placed as shown in FIG. 1. The knitted fabric fixing tool 24 includes a plate material 24*a* having a rectangular plane shape. The plate material 24*a* is attached to a horizontally moving module 26. The plate material 24*a* is moved by the horizontally moving module 26 from left to right as seen in FIG. 1. On an upper end of the plate material 24*a*, a plurality of needles 24*b* are fixedly attached. As shown in FIG. 6, the needles 24*b* are fixedly attached at an angle slanting in a right direction in FIG. 6 from their fixed bottoms toward the open ends. The knitted fabric fixing tool 24 moves the plate material 24*a* so as to sequentially pierce the needles 24*b* through the tubular knitted fabric immediately before the release of the tubular knitted fabric from the pinching transfer section 12, thereby fixing the tubular knitted fabric in a stretched state in a course direction. In this preferred embodiment, the needles 24*b* pierce through the course situated three courses below the loose course. The horizontally moving module 26 is configured to be temporarily stopped at the position where all the needles 24*b* pierce through the tubular knitted fabric.

Figure 7:
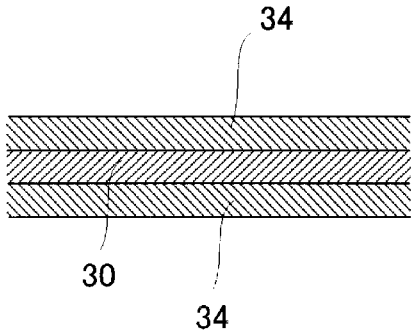
FIG. 7 is an enlarged cross-sectional view showing a light guiding plate.

Above the knitted fabric fixing tool 24, a light guiding plate 28 is provided. The light guiding plate 28 includes a metal plate 30, as shown in FIG. 7. The metal plate 30 is formed of a thin rectangular plate which is not easily deformed. On a front surface and a rear surface of the metal plate 30, transparent acrylic plates 34 are provided so as to sandwich the metal plate 30 therebetween, as shown in FIG. 7. Each of the transparent acrylic plates 34 is formed of a flat plate made of colorless or colored transparent acrylic. The transparent acrylic plate 34 has a gradually reducing thickness toward its side edges and lower edge by tapering. As a result, the side edges and the lower edge of the light guiding plate 28 are formed to have a nearly wedge-like cross-sectional shape.

A cold-cathode tube 34 is provided on an upper end of the light guiding plate 28 so as to be opposed to the light guiding plate 28. The cold-cathode tube 34 radiates a light beam onto an upper end face of the light guiding plate 28. The light guiding plate 28 irregularly reflects or outputs the light beam which is incident on its upper end face so as to emit light from its lower end face.

The light guiding plate 28 is fixedly attached to a lifting module 36 on an upper portion of its side face. The lifting module 36 raises and lowers the light guiding plate 28. The lowermost position to which the lifting module 36 can be lowered is set such that the lower end of the light guiding plate 28 is in close proximity to the needles 24*b* of the knitted fabric fixing tool 24.

Suction tools (not shown) are provided in the vicinity of the front side and rear side of the knitted fabric fixing tool 24, respectively. The suction tools serve to broaden an opening of the tubular knitted fabric fixed to the knitted fabric fixing tool 24 by air suction in front and rear directions of the knitted fabric fixing tool 24.

Opening tools 38 are provided in the vicinity of both sides of the knitted fabric fixing tool 24. Each of the opening tools 38 is provided so as to be driven in an arbitrary direction by a driving module (not shown). The opening tool 38 is configured so as to be stopped at the opening of the tubular knitted fabric by engagement therewith, and further stretches the opening of the tubular knitted fabric which is widely opened by the suction tool, in a direction in which the tubular knitted fabric is flattened. The light guiding plate 28 is lowered by the lifting module 36 so as to be inserted into the opening of the knitted fabric fixed to the knitted fabric fixing tool 24. By this operation, the light guiding plate 28 illuminates the linking loops whose image is to be picked up by CCD cameras 40 described below.

At the front side and the rear side of the light guiding plate 28, rollers 39 are movably provided. The rollers 39 further stretch the knitted fabric, in which the light guiding plate 28 is inserted, in a wale direction. The rollers 39 rotate while pressing the knitted fabric against the light guiding plate 28 so as to upwardly move the knitted fabric, thereby stretching the knitted fabric in a wale direction.

In the vicinity of the front side and rear side of the knitted fabric fixing tool 24, the CCD cameras 40 are provided. The CCD cameras 40 pick up multiple gray-scale images including images of the linking loops defining the loose course formed in the tubular knitted fabric being fixed to the knitted fabric fixing tool 24. The multiple gray-scale images picked up by the CCD cameras 40 are input to an image processor 42.

The image processor 42 detects the positions of linking loops of the tubular knitted fabric based on the multiple gray-scale images picked up by the CCD cameras 40. A pattern matching processing is used to detect the positions of the linking loops. The image of the linking loops, which is obtained by picking up the image of the linking loops of the tubular knitted fabric while the light guiding plate 28 is inserted into the tubular knitted fabric, is stored as a standard pattern in the image processor 42. The image processor 42 moves while superimposing the standard pattern onto the multiple gray-scale image input from the CCD cameras 40 so as to check whether these two images correlate at the pixel data level or not. The image processor 42 detects a pixel portion that correlates with the standard pattern as a linking loop. The positional information of the linking loops calculated by the image processor 42 is input to a CPU as information for operation control of point needle inserting units 44 which will be described later.

The point needle inserting units 44 are arranged at the front and rear of the knitted fabric fixing tool 24 at the position where the tubular knitted fabric is pierced by all the needles 24*b* of the knitted fabric fixing tool 24 so as to temporarily stop the knitted fabric fixing tool 24. Each of the point needle inserting units 44 includes a point needle position control module 46. The point needle position control module 46 moves the position of a point needle unit 48 to be attached to the point needle position control module 46 in vertical and horizontal directions with respect to the knitted fabric fixing tool 24. As the point needle position control module 46, a combination of a plurality of units of moving modules is provided. Each unit of moving modules is defined by attaching a moving module to a movable section of another moving module such as a ball-screw mechanism, a cylinder mechanism or a conveyor. Such a combination of the moving module units is provided so as to allow the vertical and horizontal movement of an attached object.

Figure 8:
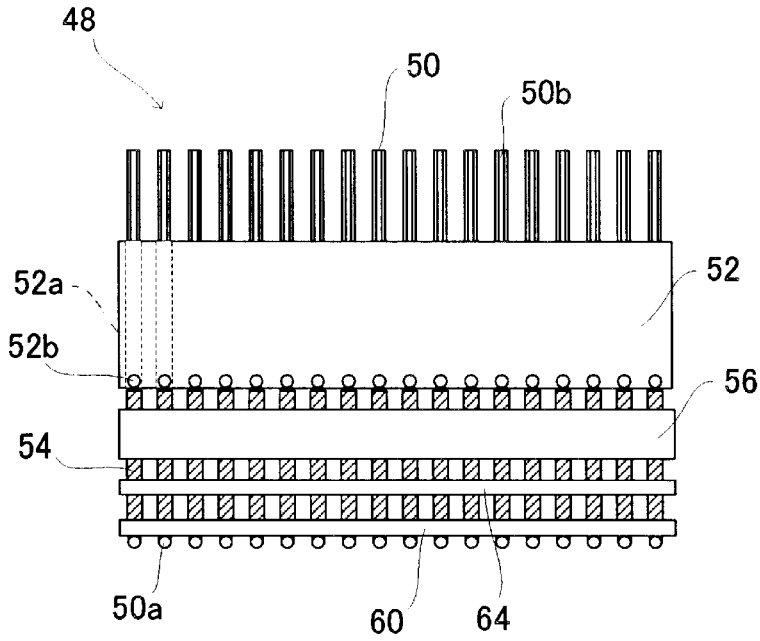
FIG. 8 is a plan view showing a point needle unit.

As described above, the point needle unit 48 is attached to the point needle position control module 46. The point needle unit 48 houses a plurality of point needles 50 to be inserted through the linking loops as shown in FIG. 8. The point needle unit 48 includes a sleeve portion 52. A plurality of through holes 52*a* are arranged horizontally in parallel through the sleeve portion 52. The point needles 50 are housed in the respective through holes 52*a* so as to be freely pushed/pulled in forward/backward directions. Each of the point needles 50 is made of a wire-like material. The point needle 50 includes a spring stopping portion 50*a* formed by upwardly bending a rear end of the point needle 50, and thus has an L-shaped configuration. On an upper face of the point needle 50, a groove 50*b* is provided, into which a sewing machine needle of a sewing machine mechanism described later is to be guided. On an upper face of the sleeve portion 52 arranged above the respective through holes 52*a*, spring stopping pieces 52*b* are attached. The number of the spring stopping pieces 52*b* corresponds to the number of the point needles 50. Each of the spring stopping pieces 52*b* is made of a wire-like material, and has an upwardly oriented open end. A spring 54 is provided in a tensioned state between the spring stopping piece 52*b* and the spring stopping portion 50*a* of the point needle 50. The point needle 50 is spring-loaded in a forward direction by tension of the spring 54. A needle stopping plate 56, which is horizontally arranged immediately above the springs 54, stops the spring stopping portion 50*a* of the point needle 50. The point needle 50, which is spring-loaded in a forward direction by the spring 54, is arranged so as to project from the sleeve portion 52 by a defined length via the needle stopping plate 56.

Figure 9:
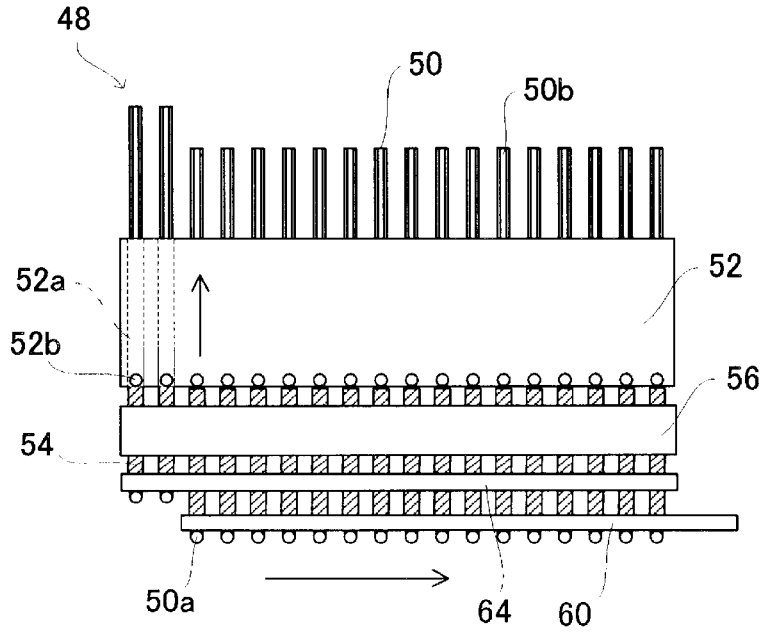
FIG. 9 is a plan view showing the point needle unit in another state.

Above the sleeve portion 52, a first point needle control plate 60 is provided through the horizontal movement module so as to be horizontally movable. As the first point needle control plate 60, a metal plate having a rectangular plane shape having a length equal to a width of the sleeve portion 52 is arranged substantially vertically. The first point needle control plate 60 stops the point needles 50 at the spring stopping portions 50*a* so as to control the movement of the point needles 50. As the control for the point needles 50 performed by the first point needle control plate 60, two operations of the point needles 50 are controlled, particularly, a pull-back operation and a pushing operation. In a pull-back operation, after placing the spring stopping portions 50*a* of all the point needles 50 so as to be stopped with the first point control plate 60 for pulling back all the point needles 50 projecting in a forward direction, the first point needle control plate 60 is moved backwardly to pull back the point needles 50. In a pushing operation, the first point needle control plate 60 is horizontally moved as shown in FIG. 9 to release the stopped spring stopping portion 50*a* from the first point needle control plate 60 so as to push the point needles 50 forward. For the operation for pushing the point needles 50, there are some cases where only one of the point needles is pushed and the other cases where a plurality of point needles 50 are pushed at a time.

Figure 10:
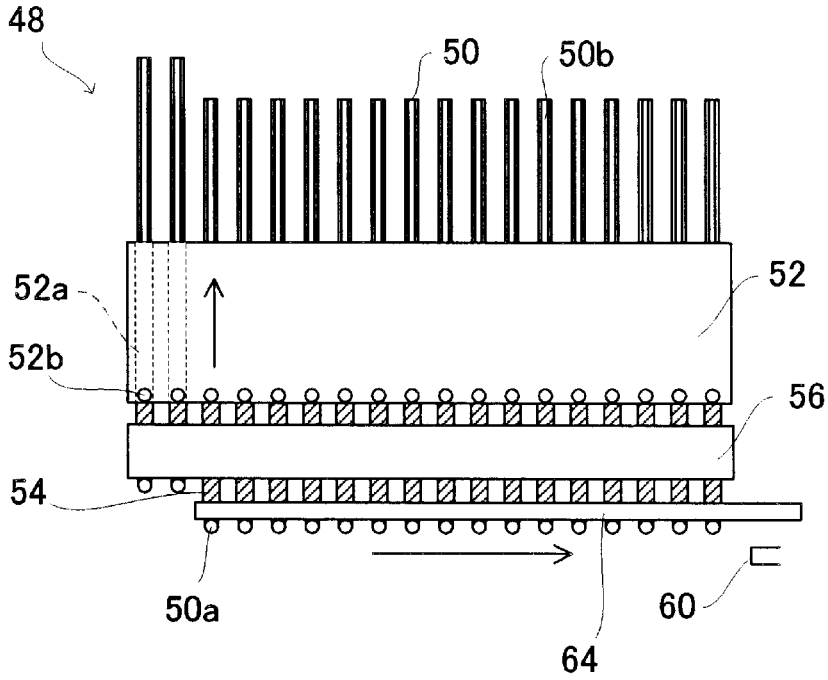
FIG. 10 is a plan view showing the point needle unit in a further state.

A second point needle control plate 64 is horizontally movably provided between the first point needle control plate 60 and the needle stopping plate 56 through the horizontally moving module. As the second point needle control plate 64, similarly to the first point needle control plate 60, a metal plate having a rectangular plane shape having a length equal to a width of the sleeve portion 52 is arranged substantially vertically. The second point needle control plate 64 controls the movement of the point needles 50 by stopping the point needles 50 released from the first point needle control plate 60 at the spring stopping portions 50*a*. The second point needle control plate 64 is arranged at a position where all the point needles 50 are stopped at the spring stopping portions 50*a* until all the point needles 50 are released from the first point needle control plate 60 so as to be pushed toward the far side. For the point needles 50 which are released from the first point needle control plate 60 so as to be stopped again by the second point needle control plate 64, the second point needle control plate 64 laterally moves as shown in FIG. 10 so as to release the stopped spring stopping portions 50*a* from the second point needle control plate 64, thereby further pushing the point needles 50. For an operation of pushing the point needles 50, as in the case of the first point needle control plate 60, there are some cases where only one point needle 50 is pushed and the other cases where a plurality of point needles 50 are pushed at a time.

A sewing machine mechanism 66 is provided in the vicinity of the point needle unit 48. As the sewing machine mechanism 66, a sewing machine for sewing a knitted fabric, which has variable moving speed of a sewing machine needle and transfer speed of a knitted fabric, is used. The sewing machine mechanism 66 is arranged so as to move in a course direction of a knitted fabric. The sewing machine mechanism 66 functions to link a knitted fabric by using the point needles 50 and to directly sew a knitted fabric without using the point needles 50.

The linking apparatus 10 includes a central control section 68. The central control section 68 is electrically and electronically connected to all of the image processor 42, the respective modules included in the linking apparatus 10, the rollers 39 and the sewing machine mechanism 66, such that various electric and electronic signals are input to the central control section 68. The central control section 68 controls the operation of each of the sections based on the input electric and electronic signals. The control by the central control section 68 will be described below in detail in the description of an operation according to this preferred embodiment.

Next, an operation of this preferred embodiment will be described. First, a tubular knitted fabric is flattened by an operator such that loops to be linked on the operator side of the tubular knitted fabric approximately coincide with those on the opposite side. The flattened tubular knitted fabric is further stretched in a course direction by the operator such that a portion including the Rosso courses is inserted between the projecting lines 14*b* of the pinching members 14*a*. The operator continues inserting the tubular knitted fabric until a rear edge of the inserted tubular knitted fabric is stopped by the gearing teeth 22*b* such that the tubular knitted fabric is transferred.

The tubular knitted fabric stopped by the gearing teeth 22*b* is horizontally transferred by the transfer chains 18*c* along the projecting lines 14*b* of the pinching members 14*a*. At this point, a portion of the tubular knitted fabric is stretched in a wale direction by the gearing teeth 22*b* and the projecting lines 14*b*. A portion of the knitted fabric is stretched in a wale direction in this manner, that is, an upper portion of the tubular knitted fabric is upwardly pulled, such that the linking loops situated immediately below the projecting lines 14*b* are arranged so as to be in contact with the lower edges of the projecting lines 14*b*. As a result, along a portion of the projecting lines 14*b* having a linear shape on the rear ends of the pinching members 14*a*, the linking loops are regularly arranged in a straight line.

The tubular knitted fabric, which continues to be horizontally transferred by the transfer chains 18*c*, is sequentially pierced through by the needles 24*b* of the horizontally moving knitted fabric fixing tool 24 for fixation thereof immediately before the tubular knitted fabric is ejected from the pinching members 14*a*. When the tubular knitted fabric is fixed over a course direction, the knitted fabric fixing tool 24 is stopped.

An opening of the tubular knitted fabric is broadened by the suction tools in forward and backward directions of the knitted fabric fixing tool 24.

The opening tool 38 is inserted through the broadened opening of the tubular knitted fabric and is stopped by engagement therewith, such that the tubular knitted fabric is further stretched in a course direction.

The light guiding plate 28 is inserted into the broadened opening of the tubular knitted fabric from above the knitted fabric fixing tool 24.

After insertion of the light guiding plate 28, the opening tool 38 is released from the opening of the tubular knitted fabric such that the tubular knitted fabric is in close contact with the light guiding plate 28.

The rollers 39 are placed in front and rear of the light guiding plate 28 so as to press the tubular knitted fabric against the light guiding plate 28. The rollers 39 rotate while pressing the knitted fabric against the light guiding plate 28 so as to upwardly move the knitted fabric, thereby stretching the knitted fabric in a wale direction. At this point, a portion of tubular knitted fabric in the vicinity of the linking loops is illuminated with light emitted from the light guiding plate 28, from inside of the tubular knitted fabric.

Images of the linking loops of the tubular knitted fabric which is stretched in a course direction and a wale direction are picked up by the CCD cameras 40. The multiple gray-scale images including the images of the linking loops on the front side and the back side, which are picked up by the CCD cameras 40, are input to the image processor 42 so as to calculate the positions of the linking loops.

After the position of the point needle unit 48 is adjusted by the point needle position control module 46, the first point needle control plate 60 is horizontally moved to insert the point needles 50 through the linking loops on the front side, whose positions are calculated by the image processor 42. In the case where a plurality of linking loops are positioned such that these loops can be simultaneously pierced through by the point needles 50, the first point needle control plate 60 is horizontally moved such that a plurality of the point needles 50 are pushed forward. The point needles 50 are not inserted through the linking loops situated in the vicinity of the edges of the tubular knitted fabric in a course direction, but are inserted through all the remaining linking loops. In this preferred embodiment, all the linking loops other than those situated at both extremities of the knitted fabric and adjacent thereto are pierced through the point needles 50.

After all the linking loops on the front side other than those situated at both extremities of the knitted fabric and adjacent thereto are pierced through by the point needles 50, the position of the point needle unit 48 is adjusted by the point needle position control module 46. Thereafter, the second point needle control plate 64 is controlled so as to insert the point needles 50 through the linking loops on the back side.

Then, the light guiding plate 28 are upwardly pulled out from the tubular knitted fabric.

On the back side of the tubular knitted fabric, the sewing machine mechanism 66 is arranged so as to sew the tubular knitted fabric. The sewing machine mechanism 66 sews the tubular knitted fabric such that each of the linking loops, through which the point needles 50 are not inserted, is threaded several times regardless of the position of the linking loops. Then, the sewing machine mechanism 66 threads the linking loops, through which the point needles are inserted, by utilizing the grooves 50*b* formed on the point needles 50.

In this manner, according to this preferred embodiment, an inserting operation of the point needles through the linking loops formed in the tubular knitted fabric is quickly and accurately performed in an automatic manner, allowing the tight linking of the tubular knitted fabric.

Although the linking of the tubular knitted fabric has been described in this preferred embodiment, the present invention is not limited thereto. It is possible to link two flat knitted fabrics, which are set in the pinching transfer section so as to be opposed to each other.

Moreover, in this preferred embodiment the knitted fabric is fixed to the knitted fabric fixing tool in its stretched state in the pinching transfer section. Alternatively, the knitted fabric may be manually fixed to the knitted fabric fixing tool.

Furthermore, although the light guiding plate is used such that a boundary between a knitted portion of the knitted fabric and a portion where no knitting yarn is present becomes clearly visible in this preferred embodiment, the present invention is not limited thereto. Alternatively, a mere plate material having a distinctly different color tone from that of the knitting yarn may be used.

Moreover, instead of the light guiding plate, a member for performing uniform surface light emission such as an EL panel or a plasma display can also be used.

Although the tubular knitted fabric is brought into close contact with the surface of the light guiding plate in this preferred embodiment, the present invention is not limited thereto. A plate like material may be simply arranged such that a boundary between a knitted portion of the knitted fabric and a portion where no knitting yarn is present becomes clearly visible.

Figure 11:
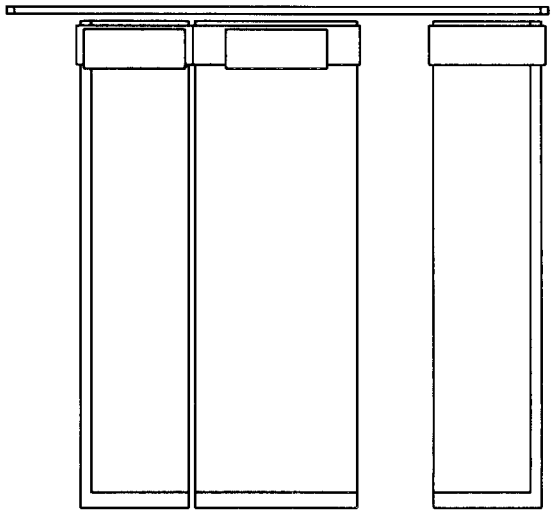
FIG. 11 is a diagram showing another example of a light guiding plate in one state.
Figure 12:
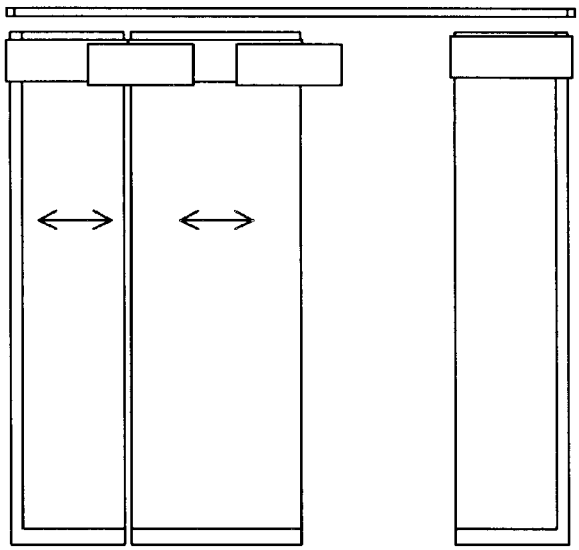
FIG. 12 is a diagram showing the light guiding plate of FIG. 11 in another state.

Although a single light guiding plate is used as the light guiding plate in this preferred embodiment, the present invention is not limited thereto. A plurality of light guiding plates which are arranged so as to be movable as shown in FIG. 11 may also be used as the light guiding plate of the present invention. In such a case, as shown in FIG. 12, when the light guiding plates are to be inserted into a knitted fabric, it is preferable that the light guiding plates are arranged so as to define a small width for facilitating the insertion. After insertion, the light guiding plates are adjusted so as to be extended in a course direction of the knitted fabric.

Furthermore, although a plate material having a rectangular plane shape is used as the knitted fabric fixing tool in this preferred embodiment, the present invention is not limited thereto. A knitted fabric fixing tool formed by fixedly attaching a plurality of needles on an upper edge of the outer periphery of a cylindrical member may alternatively be used as the knitted fabric fixing tool. In this case, it is preferable to use a cylindrical member having the outer periphery having a relatively low curvature such that the needles do not fall out of a knitted fabric when a planar plate such as the light guiding plate is inserted into the knitted fabric.

Although the linking loops on the front side and the back side are arranged to be pierced through by a single point needle unit in this preferred embodiment, the present invention is not limited thereto. Alternatively, point needle units may be arranged on the front side and the back side, respectively. In this case, after the point needles are inserted through the linking loops, the tips of the point needles on the both sides, which are inserted through the loops to be linked, are abutted to each other such that the knitted fabric on one side is transferred to the point needle on the other side.

Figure 13:
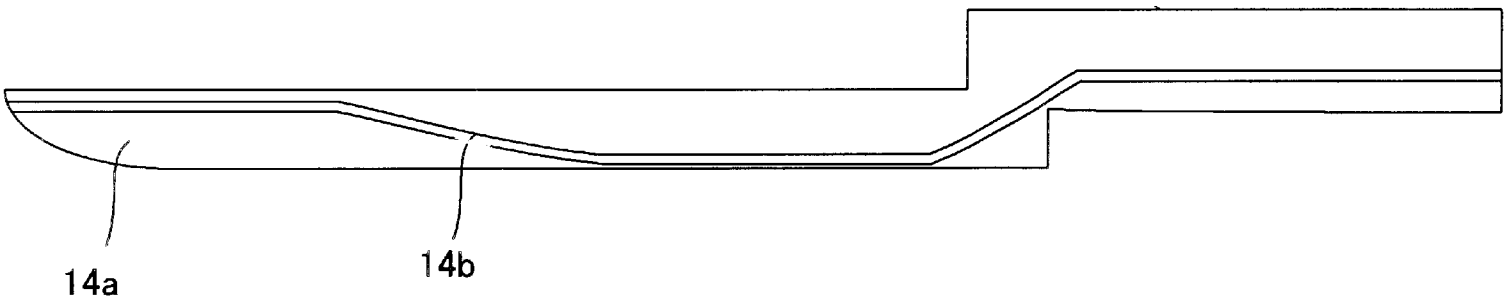
FIG. 13 is a diagram showing another pinching member.

Although the rollers are used for stretching the knitted fabric in a wale direction in this preferred embodiment, the present invention is not limited thereto. The knitted fabric may be stretched in a wale direction by using a pinching member as shown in FIG. 13. In the case where this pinching member is used, after a needle of the knitted fabric fixing tool pierces through the knitted fabric, the knitted fabric is stretched in a wale direction by the needles and projecting lines. In the case where this pinching member is used, the point needles may be pierced through the knitted fabric on the rear end of the pinching member without releasing the knitted fabric from the pinching member.

As described above, according to the present invention, a point needle is quickly and accurately inserted through linking loops formed in a knitted fabric in an automatic manner, thereby tightly linking the knitted fabric.

The present invention is in no way restricted to the preferred embodiments described above. Instead, various adaptations and modifications may be made with regard to specific patterns of the main line and sub line, the number of layers for layered structures, and other characteristics and features, without departing from the spirit or scope of the invention.

What is claimed is:

1. A method for linking knitted fabrics, each having a loose course for linking, comprising the steps of:

opposing the knitted fabrics to be linked to each other;

stretching the opposed knitted fabrics in a course direction;

stretching the opposed knitted fabrics in a wale direction;

picking up a multiple gray-scale image including an image of linking loops defining a loose course of each of the stretched knitted fabrics;

performing an image processing on the multiple gray-scale image so as to detect positions of the linking loops;

inserting a point needle through each of the linking loops;

sewing a linking loop in a vicinity of an edge of each of the knitted fabrics; and threading the linking loops other than the sewn linking loop by using the point needle inserted through the linking loop so as to link the knitted fabrics together.

2. The linking method according to claim 1, wherein step of sewing the linking loop in the vicinity of the edge of each of the knitted fabrics includes threading one linking loop a plurality of times.

3. The linking method according to claim 1, wherein the step of stretching the opposed knitted fabrics in the course direction includes piercing a plurality of needles through the knitted fabrics while the knitted fabrics are being stretched in the course direction so as to fix the knitted fabrics.

4. The linking method according to claim 1, wherein the step of stretching the opposed knitted fabrics in the course direction further includes the steps of:

pinching the opposed knitted fabrics in a stretched state in the course direction; and piercing a plurality of needles through the knitted fabrics which are pinched in a stretched state so as to fix the knitted fabrics.

5. The linking method according to claim 1, wherein the step of performing the image processing on the multiple grayscale image so as to detect the positions of the linking loops includes detecting the positions of the linking loops by pattern matching.

6. The linking method according to claim 1, further comprising the step of placing a plate-like material between the opposed knitted fabrics, the plate-like material having a visual effect allowing clear visualization of a boundary between a knitted portion of the knitted fabric and a portion including no knitting yarn.

7. The linking method according to claim 6, wherein the plate-like material emits light.

8. The linking method according to claim 1, wherein the knitted fabrics define a tubular knitted fabric, and the step of opposing the knitted fabrics to be linked involves opposing the knitted fabrics to each other into a shape to be formed by linking the tubular knitted fabric.

9. The linking method according to claim 4, wherein each of the knitted fabrics includes a course having a thin thickness, and the step of pinching the opposed knitted fabrics in the stretched state in the course direction includes pinching each of the knitted fabrics at the course having the thin thickness.

10. The linking method according to claim 9, wherein each of the knitted fabrics includes a loose course formed in a vicinity of the course having the thin thickness, and the step of pinching the opposed knitted fabrics in the stretched state in the course direction involves pulling a side of each of the knitted fabrics where the loose course is not formed in a state where the knitted fabrics at the course formed to have the thin thickness are pinched so as to arrange the loose course along an edge of a member pinching the knitted fabrics.

11. A linking apparatus for linking knitted fabrics, each having a loose course for linking, comprising:

a course stretching device for stretching the knitted fabrics in a course direction in a state where the knitted fabrics are opposed to each other;

a wale stretching device for stretching the opposed knitted fabrics in a wale direction;

an image-pickup device for picking up a multiple gray-scale image including an image of linking loops defining a loose course of each of the stretched knitted fabrics;

a linking loop detector for performing an image processing on the multiple gray-scale image so as to detect positions of linking loops;

a point needle insertion device for inserting a point needle through each of the linking loops; and a sewing machine mechanism for sewing a linking loop in a vicinity of an edge of each of the knitted fabrics and for threading the linking loops other than the sewn linking loop by using the point needle inserted through the linking loops to link the linking loops together.

12. The linking apparatus according to claim 11, wherein the sewing machine mechanism threads the linking loop in the vicinity of the edge of each of the knitted fabrics a plurality of times.

13. The linking apparatus according to claim 11, wherein the course stretching device includes a plurality of needles piercing through the knitted fabrics while the knitted fabrics are being stretched in the course direction.

14. The linking apparatus according to claim 11, wherein the course stretching device includes:

a pinching device for pinching the opposed knitted fabrics in a stretched state in the course direction; and a fixation device for piercing a plurality of needles through the knitted fabrics which are pinched in a stretched state so as to fix the knitted fabrics.

15. The linking apparatus according to claim 11, wherein the linking loop detection device detects the positions of the linking loops by pattern matching.

16. The linking apparatus according to claim 11, further comprising:

a plate-like material having a visual effect allowing clear visualization of a boundary between a knitted portion of the knitted fabric and a portion including no knitting yarn when the plate-like material is placed between the opposed knitted fabrics.

17. The linking apparatus according to claim 16, wherein the plate-like material is a light emitter.

18. The linking apparatus according to claim 11, wherein the knitted fabrics define a tubular knitted fabric, and the course stretching device and the wale stretching device stretch the tubular knitted fabric while the knitted fabrics are being opposed to each other into a shape to be formed by linking the tubular knitted fabric.

19. The linking apparatus according to claim 14, wherein each of the knitted fabrics includes a course having a thin thickness, and the pinching device pinches each of the knitted fabrics at the course having the thin thickness.

20. The linking apparatus according to claim 19, wherein each of the knitted fabrics includes a loose course formed in a vicinity of the course having the thin thickness, and the pinching device includes a pulling device for pulling a side of each of the knitted fabrics where the loose course is not formed in a state where the knitted fabrics at the course having the thin thickness are pinched so as to arrange the loose course along an edge of the pinching means.

* * * * *